US005323976A

United States Patent [19]

Johnson et al.

[11] Patent Number: 5,323,976

[45] Date of Patent: Jun. 28, 1994

[54] LIFT LINE CONNECTION FOR ROCK CRUSHER COMPONENTS

[76] Inventors: Louis W. Johnson; Bruce G. Johnson, both of 2435 Prairie Rd., Eugene, Oreg. 97402

[21] Appl. No.: 8,221

[22] Filed: Oct. 12, 1929

Related U.S. Application Data

[63] Continuation of Ser. No. 848,155, Mar. 9, 1992, abandoned.

[51] Int. Cl.[5] ..... B02C 23/00

[52] U.S. Cl. ..... 241/286; 241/293

[58] Field of Search ..... 241/293, 286; 403/205, 403/405.1, 403

[56] References Cited

U.S. PATENT DOCUMENTS 3,355,114 11/1967 Motz ..... 241/293
4,289,280 9/1981 Mitrofanov ..... 241/286 X
4,710,208 12/1987 Ziemer et al. ..... 403/403 X
4,830,531 5/1989 Condit et al. ..... 403/405.1

OTHER PUBLICATIONS

Unpublished drawings by ESCO Corporation dated Nov. 7, 1988.

*Primary Examiner*—Mark Rosenbaum
*Assistant Examiner*—Frances Chin

[57] ABSTRACT

At least one core hole is provided adjacent an edge of a rock crusher component and removably receives a connector capable of attachment to a lifting line. In one embodiment, the connector is a bolt and the core hole has an enlarged portion for receiving a nut in a non-rotating fit. The nut receives a set screw plug when the bolt is removed. In another embodiment a hook and eye member is employed and the hook portion thereof engages the enlarged portion of the core hole. The connector includes a bracket that connects it with a lift line.

8 Claims, 2 Drawing Sheets

LIFT LINE CONNECTION FOR ROCK CRUSHER COMPONENTS

This application is a continuation, of application Ser. No. 07/848,155, filed Mar. 9, 1992 now abandoned.

BACKGROUND OF THE INVENTION

This invention relates to new and useful improvements in a lift line connection for rock crusher components.

Manufacturers of rock crushers universally use manganese steel and variations of it for the construction of wear mantles or jaw plates. These components require replacement after a given amount of service, or they require repair at times, and it is customary in the trade to weld eyes to upper portions of these heavy parts for handling by cranes or other powered machinery.

Manganese steel and variations of it are austenitic and require welding rods made of stainless steel or welding rods made especially for welding such steels. These types of steel cannot safely be welded with the usual carbon steel welding rods since the latter are designed to weld only mild steels. The special rods for welding manganese steel and its variations are very expensive and workmen often substitute carbon steel welding rods to save expenses, or the improper welding rods are sometimes used because of ignorance of the workmen or simply because of improper instructions or the failure to receive proper instructions. When using the improper welding rods to weld the lifting eyes onto the manganese rock crusher components, the weld-bonding fusion area between the weld beads and the manganese steel is brittle and cannot withstand an impact nor much tension and will break like glass, thus possibly resulting in serious accidents.

SUMMARY OF THE INVENTION

It is an object of the present invention to provide a new and novel lift line connection for rock crusher components that eliminates the need of welding lifting eyes to them, and in particular provides such a connection that has a portion thereof formed integrally in the component for receiving a bolt or hook which insures a safe lifting connection to a crane or other powered machinery.

For the purpose of achieving such objective, a mantle or jaw component of a rock crusher is provided with one or more receptacle means, preferably core holes, adjacent an upper edge thereof. Each core hole is associated with a connector to which lifting line means from a crane may be attached. In one embodiment of the invention, each connector comprises a bolt and nut, and the core hole therefor has an enlarged portion for receiving the nut or the head of the bolt. The bolt clamps a lifting line bracket to the component. In another embodiment, a hook and eye member is employed as the connector. The hook portion of this member engages the enlarged portion of the core hole and the eye portion is connectible to a lifting line. On some types of crushers such as cone and gyratory, at least two lift lines should be used for balanced lifting. The connectors are removable from the component so as to be out of the way during crusher use and for re-use of the connectors.

The invention will be better understood and additional objects and advantages will become apparent from the following description taken in connection with the accompanying drawings.

DETAILED DESCRIPTION OF PREFERRED EMBODIMENTS

Figure 6:
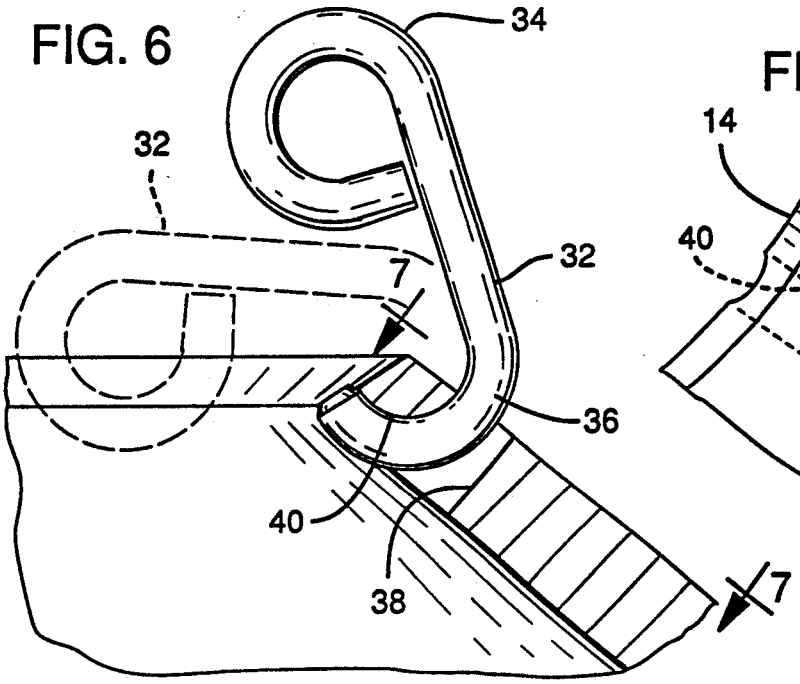
FIG. 6 is also a view taken similar to FIG. 2 but showing a second embodiment of the invention.
Figure 7:
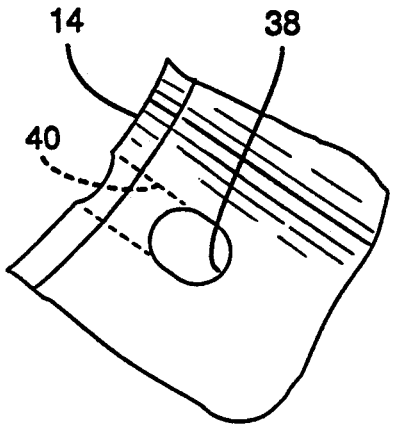
FIG. 7 is a fragmentary plan view taken on the line 7—7 of FIG. 6 with the connector removed.
Figure 8:
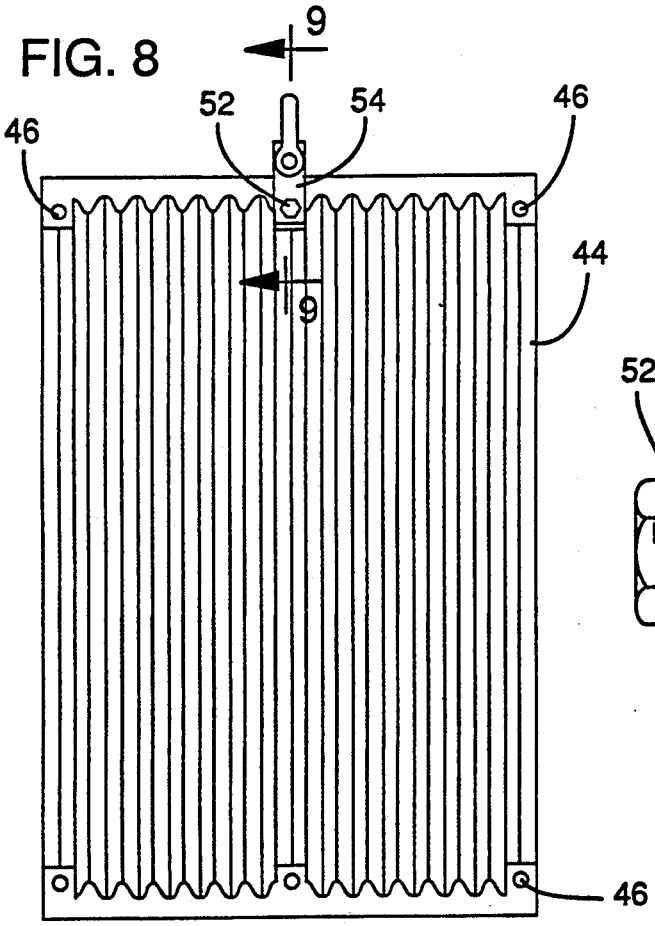
FIG. 8 is a face view of a jaw crusher component and showing a connector embodiment similar to FIG. 1 as applied to this type of crusher component.
Figure 9:
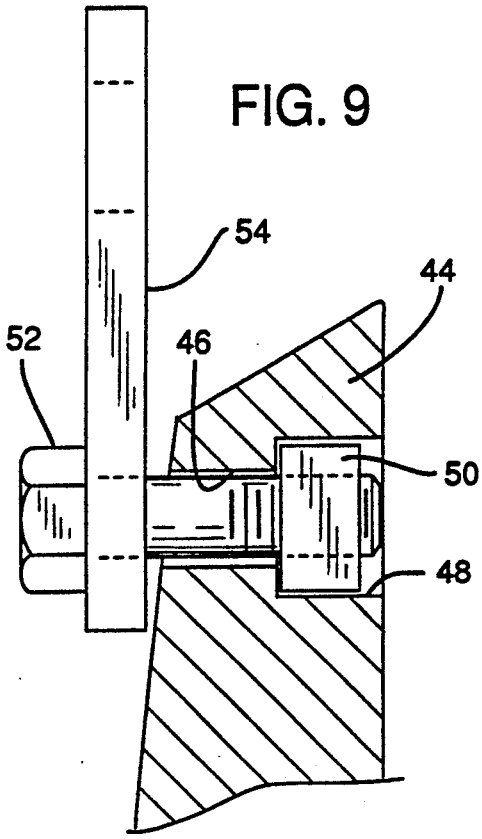
FIG. 9 is an enlarged sectional view taken on the line 9—9 of FIG. 8.

With reference to the drawings, the invention may be applied to a cone or gyratory type crusher as shown in FIGS. 1–7 or a jaw type crusher as shown in FIGS. 8 and 9. As noted above, its purpose is to provide a connection for the safe lifting of wear mantles for the cone or gyratory crushers or flat jaw plates for the jaw crushers to avoid the dangers of using welded-on crane lifting eyes.

Figure 1:
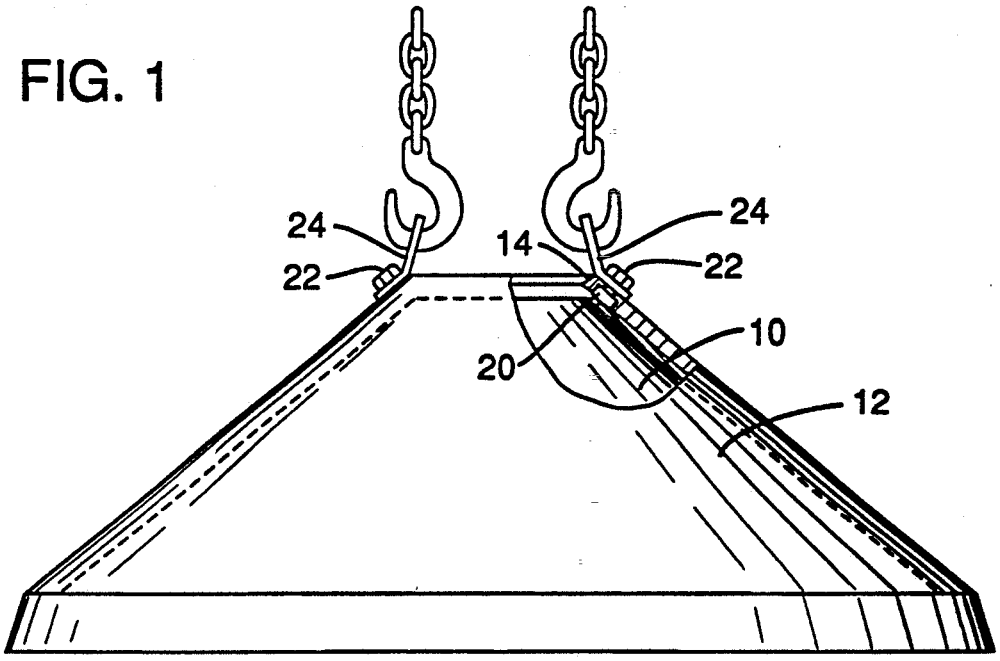
FIG. 1 is an elevational view, partially broken away, of a first embodiment of the invention wherein the present lift line connection is associated with a mantle component of a cone-type rock crusher.
Figure 2:
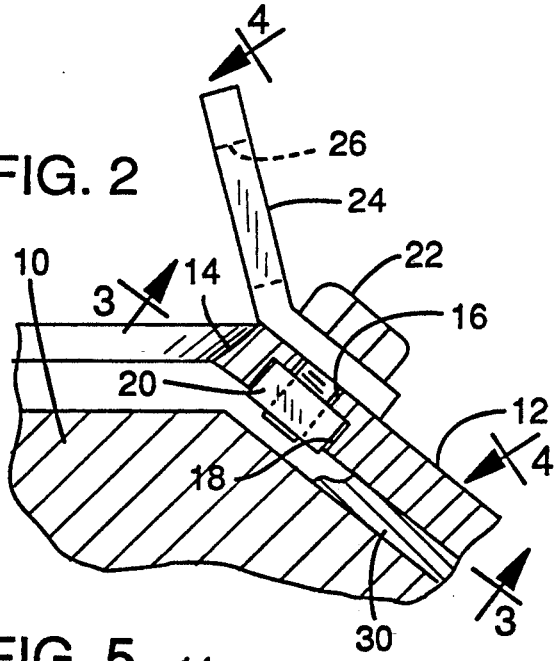
FIG. 2 is an enlarged sectional detail view of the connection of FIG. 1.
Figure 3:
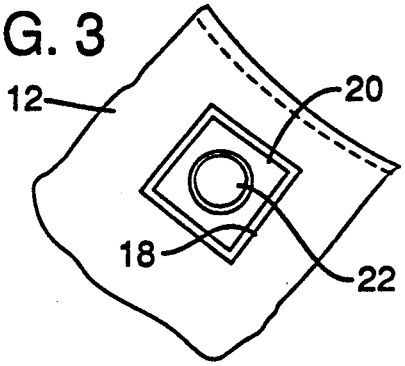
FIG. 3 is a fragmentary bottom plan view taken on the line 3—3 of FIG. 2.
Figure 4:
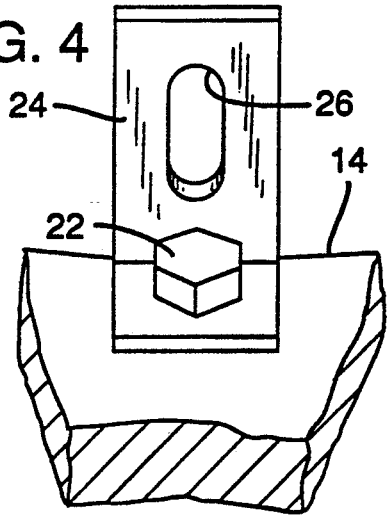
FIG. 4 is a fragmentary elevational view taken on the line 4–4 of FIG. 2.
Figure 5:
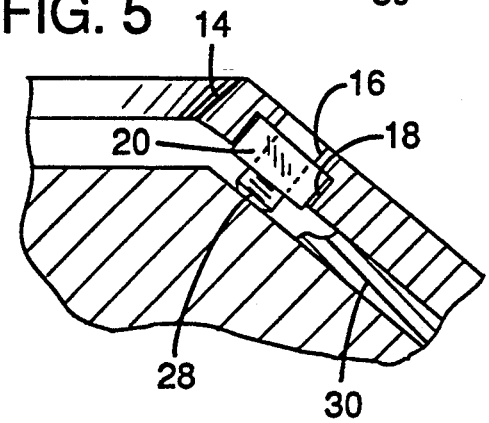
FIG. 5 is a view similar to FIG. 2 but showing a set screw retainer in a non-lifting condition of the invention.

Cone or gyratory crushers have a cone-shaped head 10, FIGS. 1 and 2, that is operated in association with a bowl assembly, not shown, for crushing rock between them. The head is protected by a mantle 12 of abrasion-resistant manganese steel of varying alloys all of which are austenitic. Some attempts to use other steels or chilled iron have proved to be inferior to manganese steel, such metals being even more difficult to weld, if not impossible. These mantles are very heavy and require on and off lifting by powered machinery such as a crane. Mantles have the shape of a frustum of a cone with a short cut-off segment at the top and terminating in a top edge 14. According to the embodiment of FIGS. 1–5, the mantle 12 is provided with receptacle means in the form of core holes 16 spaced down a short distance from the top edge 14 of the mantle. Preferable two of such core holes are used in diametric relation but more or less of such holes may be provided. Each core hole 16 terminates on the inner surface of the mantle in a recess 18 for receiving a nut 20 of a bolt 22 capable of being removably mounted in the core hole 16. Preferably, the recesses 18 and nuts are square shaped for ease of casting and for greater tolerances to self-lock. The bolt may be positioned in inverted position from that shown, namely, the head thereof could be located in the recess 18 and the nut exposed, in which case the recess and bolt head will assume the same shape, preferably square. In this latter structure the bolts are left in the mantle because they cannot be extracted.

Bolts 22 are used to clamp lifting brackets 24 to the upper exterior portion of the mantle. These brackets have suitable openings 26 for connection to lifting lines L, as shown in FIG. 1, operated by powered lifting machinery. After the mantle is set in place, the bolts 22 can be removed and the brackets 24 as well as the bolts re-used. With the nuts of the bolts in the recesses, as shown in FIG. 2, they can remain in place in a trapped position. If desired, after the bolts have been removed, Allen set screw plugs 28, FIG. 5, can be installed in threaded engagement with the nuts. Allen set screws for this purpose are of a type that have no head and are of a length that when inserted, the heads thereof are substantially flush with the outer surface of the nuts and the tip ends are in engagement with the cone head. The screws will thus be protected from wear and at the time of mantle change the core holes 16 can be cleaned out for access to the Allen screws for removal, thus locking the nuts in a fixed position.

A space usually exists in areas between the head and the mantle in the upper areas thereof, and in conventional practice this space is filled with a special epoxy or molten zinc 30. The backing filler is inserted by conventional practice or through the core holes if desired prior to installing the set screws and terminates short of the core holes. The present lift line connection does not interfere with this filled area.

The embodiment shown in FIGS. 6 and 7 comprises a lifting hook 32 that serves as a one-piece connector between the mantle and a lifting line. The hook comprises an upper eye end 34 for attachment to a lifting line and a lower hook end 36 that engages in receptacle means in the form of a core hole 38 provided in spaced but close association with the top of the mantle. A notch 40 extends from the core hole 38 to the upper end of the mantle on the inner surface of the mantle and is curved selectively similar to the curvature of the hook end 36 to provide a positive and safe lifting connection between these elements. This hook is readily removed by tipping it inward as shown in dotted lines in FIG. 6 or if it cannot be removed because it will not tip far enough, it can be cut off with a torch.

The connection shown in FIGS. 8 and 9 is similar to t he embodiment of FIGS. 1–4 but shows the bolt-type connector of the invention as applied to a flat jaw plate 44 of a jaw crusher. According to the invention the jaw plate has one or more core holes 46 adjacent one or both of the upper and lower ends. As shown in FIG. 8, a single lifting connection can be provided laterally in the center, although if desired one on each side for a double lifting connection can be provided. The core holes have a recess 48 for the nuts 50 of bolts 52 installed in the core holes similar to the FIG. 1 embodiment. The bolts 52 and brackets 54 are removable for re-use and provide a positive and safe lifting connection to these heavy crusher parts as opposed to questionable connector means in the form of eyes attached by welding.

It is to be understood that the forms of our invention herein shown and described are to be taken as preferred examples of the same and that various changes in the shape, size and arrangement of parts may be resorted to without departing from the spirit of our invention, or the scope of the subjoined claims.

Having thus described our invention, we claim:

1. A rock crusher comprising:

a rock engaging component removably mounted in said crusher, said rock engaging component having upper and lower ends and also having a wall thickness with a rock crushing outer surface and an opposite surface, a core hole extending through the wall thickness of said rock engaging component between said rock crushing outer surface and said opposite surface and located adjacent the upper end of said rock engaging component, said core hole forming lifting receptacle means, and a connector removably mounted in said lifting receptacle means to which a lifting line from powered machinery is arranged to be attached.

2. A mantle for a rock crusher comprising:

a cone-shaped member having upper and lower ends and also having a wall thickness with a rock crushing outer surface and an opposite surface, said cone-shaped member being removably mounted on a support in said crusher with a spacing between said opposite surface and said support, a backing filler in said spacing between said opposite surface and said support, at least one core hole in an upper portion of said cone-shaped member extending through the wall thickness of said cone-shaped member between said rock crushing outer surface and said opposite surface and located adjacent the upper end of said cone-shaped member, and a connector arranged to be removably mounted in said core hole to which a lifting line from powered machinery can be attached, said core hole also serving as a filler opening for said backing filler material with said connector removed from said cone-shaped member.

3. A mantle for a rock crusher comprising:

a cone-shaped member having upper and lower ends and also having a wall thickness with a pair of opposite surfaces one of which comprises a rock crushing surface, said cone-shaped member being removably mounted on a support in said crusher, at least one core hole in said cone-shaped member extending through the wall thickness of said cone-shaped member between said opposite surfaces and adjacent an upper portion thereof, a connector arranged to be removably attached to said core hole to which a lifting line from powered machinery can be attached, said core hole having an enlarged portion in the surface thereof opposite from said rock crushing surface, and a nut removably fitted in said enlarged portion, said nut being arranged to threadedly receive a lifting bolt as said connector when said cone-shaped member is to be attached to a lifting line.

4. The structure of claim 3 wherein said connector includes a bolt in said core hole and a nut is removably fitted in said enlarged portion against rotation, and a lifting bracket removably clamped to said cone-shaped member by said bolt.

5. The structure of claim 3 wherein said nut being arranged to receive a set screw plug therein when said lifting bolt is removed from said nut.

6. The structure of claim 3 wherein said connector including means removably engageable in said enlarged portion of said core hole for removable attachment of said connector to said cone-shaped member.

7. The structure of claim 6 wherein said connector comprises a bolt and a nut, said enlarged portion of said core hole removably receiving one of said nut and the head of said bolt for connection of the connector to said cone-shaped member.

8. The structure of claim 6 wherein said connector comprises a hook and eye member said enlarged portion of said core hole removably receiving said hook for connection of the connector to said cone-shaped member.

* * * * *